US006889654B2

(12) United States Patent
Ito

(10) Patent No.: US 6,889,654 B2
(45) Date of Patent: May 10, 2005

(54) ELECTRONIC THROTTLE CONTROL FOR WATERCRAFT

(75) Inventor: Kazumasa Ito, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/852,649

(22) Filed: May 24, 2004

(65) Prior Publication Data

US 2004/0231642 A1 Nov. 25, 2004

(30) Foreign Application Priority Data

May 22, 2003 (JP) ..... 2003-144402

(51) Int. Cl.[7] ..... F02D 1/00

(52) U.S. Cl. ..... 123/396; 123/399; 73/118.1; 73/119 R

(58) Field of Search ..... 123/396, 399, 123/400; 73/118.1, 119 R

(56) References Cited

U.S. PATENT DOCUMENTS

| | | | | |
|---|---|---|---|---|
| 4,244,333 | A | 1/1981 | Matsumoto | |
| 4,388,894 | A | 6/1983 | Tanaka et al. | |
| 4,580,537 | A | 4/1986 | Uchiyama | |
| 4,587,937 | A | 5/1986 | Masuda | |
| 4,611,561 | A | 9/1986 | Suyama | |
| 4,805,572 | A | 2/1989 | Fujita et al. | |
| 4,898,137 | A | 2/1990 | Fujita et al. | |
| 5,000,130 | A | 3/1991 | Yamada | |
| 5,062,815 | A | 11/1991 | Kobayashi | |
| 5,410,993 | A | 5/1995 | Masuda et al. | |
| 5,575,246 | A | 11/1996 | Ito | |
| 5,598,813 | A | 2/1997 | Masuda et al. | |
| 5,605,119 | A | 2/1997 | Masuda et al. | |
| 5,626,120 | A | 5/1997 | Akatsuka | |
| 5,921,225 | A | 7/1999 | Nakamura | |
| 5,934,958 | A | 8/1999 | Ochiai | |
| 6,007,392 | A | 12/1999 | Motose | |
| 6,019,090 | A | 2/2000 | Ozawa | |
| 6,039,013 | A | 3/2000 | Motose | |
| 6,155,374 | A | 12/2000 | Uchida | |
| 6,158,368 | A | 12/2000 | Nanami | |
| 6,227,922 | B1 | 5/2001 | Ochiai | |
| 6,520,167 | B1 * | 2/2003 | Kanno | 123/674 |
| 6,551,153 | B1 | 4/2003 | Hattori | |
| 6,699,085 | B2 | 3/2004 | Hattori | |
| 6,709,302 | B2 * | 3/2004 | Yanagihara | 440/1 |
| 2001/0036777 | A1 * | 11/2001 | Lida et al. | 440/84 |
| 2002/0155766 | A1 * | 10/2002 | Hattori | 440/88 |
| 2003/0013354 | A1 * | 1/2003 | Yanagihara | 440/1 |

FOREIGN PATENT DOCUMENTS

| | | |
|---|---|---|
| EP | 0 030 022 | 6/1981 |
| EP | 0 054 964 | 6/1982 |

* cited by examiner

*Primary Examiner*—John T. Kwon
(74) *Attorney, Agent, or Firm*—Knobbe, Martens, Olson & Bear, LLP

(57) ABSTRACT

A watercraft has an engine that is controlled by an electronic control unit and the engine is controlled by an electronic throttle. The electronic throttle is actuated by a motor that is controlled by and electronic control unit. The ECU operates the electronic throttle according to a torque request from an operator. The electronic throttle is also periodically and/or at predetermined time intervals actuated to ensure proper operation of the throttle valve.

14 Claims, 9 Drawing Sheets

ELECTRONIC THROTTLE CONTROL FOR WATERCRAFT

PRIORITY INFORMATION

This application is based on and claims priority to Japanese Patent Application No. 2003-144402, filed May 22, 2003, the entire contents of which is hereby expressly incorporated by reference.

BACKGROUND OF THE INVENTION

The present application generally relates to an electronic throttle control for a watercraft, and more particularly relates to actuating an electronic throttle periodically and/or at predetermined time intervals in order to assure the proper operation of the electronic throttle.

DESCRIPTION OF THE RELATED ART

Personal watercraft are a relatively small sporty-type of watercraft wherein the rider sits or stands more on top of the watercraft than in other types of watercraft. Typically, a personal watercraft is designed to be operated by a single rider or operator, although accommodations are frequently made for one or more passengers.

Personal watercrafts are typically powered by an internal combustion engine. Fuel is supplied to the engine by charge formers, which can be carburetors or fuel injectors depending upon the application. Air is supplied to the engine by an air induction system. Located within the air induction system is one or more throttle valves that regulate the amount of air delivered to the engine. Because fuel flow is typically metered in proportion to the air flow, the throttle valves, in essence, control the power output of the engine and thus the speed of the watercraft as is well known in the art.

Personal watercraft typically include a handlebar that is mounted to an upper deck of the watercraft. The operator uses the handlebar to steer the watercraft. On the handlebars, near a grip, is a throttle lever. The throttle lever is typically directly coupled to the throttle valves by one or more cables. Accordingly, the operator controls the position of the throttle valves and thereby the speed the watercraft by moving the throttle lever.

The throttle valves are normally biased to an idling position by one or more return springs. Another spring biases the throttle lever back to an unactuated position that corresponds to the idle position of the throttle valves. In order to further open the throttle valves and increase the speed of the watercraft, the operator typically grasps the throttle lever with one or more of her fingers and moves the lever towards the handlebar grip. When the operator releases the throttle lever, the return springs force the throttle valves and the throttle lever back to the idling position. Therefore, in order to maintain the speed of the watercraft, the operator must hold the throttle lever at a specific position against the return force of the return springs. Furthermore, if the operator's fingers slip, the throttle lever will return quickly to the idling position causing the watercraft to decelerate suddenly.

More recently, it has been proposed to provide personal watercraft, as well as many other types of vehicles, with electronically controlled throttle valves.

SUMMARY OF THE INVENTION

An aspect of at least one of the inventions disclosed herein includes the realization that watercraft engines that use an electronic throttle to control the engine speed can experience a sticking throttle due to corrosion from environmental conditions. Additionally, as such corrosion accumulates, the speed at which the throttle valve moves slows. Such a slowing of throttle valve response can be detected. Another aspect of at least one of the inventions disclosed herein includes the realization that such slowing can be used to determine if the throttle valve should be cleaned.

In accordance with one embodiment, an engine comprises a controller communicating with at least a throttle lever position sensor, a throttle motor, and a throttle position sensor. The controller is configured to control the throttle motor to move a throttle to a predetermined position according to a signal from a throttle lever that is connected to the throttle lever position sensor, to compare a signal from the throttle position sensor to the signal from the throttle lever position sensor and to adjust the throttle position to a corrected throttle position according to the sensed throttle lever position. The controller is further configured to periodically activate the throttle motor to open the throttle to a predetermined position for a predetermined amount of time without an input signal from the throttle lever position sensor.

In accordance with another embodiment, a method of controlling a parameter of a multi-cylinder engine comprises sensing a position of a throttle lever, controlling a motor that activates a throttle according to the position of the throttle lever, sensing a throttle position and comparing the sensed throttle position with the sensed throttle lever position and adjusting the throttle position to a corrected throttle position according to the sensed throttle lever position. The method also includes periodically activating the motor at a predetermined time for a predetermined amount of time according to a predetermined condition.

In accordance with yet another embodiment, an engine comprises a controller communicating with at least a throttle ever position sensor, a throttle motor, and a throttle position sensor. The controller is configured to control the throttle motor to move a throttle to a predetermined position according to a signal from a throttle lever that is connected to the throttle lever position sensor, to compare a signal from the throttle position sensor to the signal from the throttle lever position sensor and to adjust the throttle position to a corrected throttle position according to the sensed throttle lever position. The engine also includes means for periodically activating the throttle motor to open the throttle to a predetermined position for a predetermined amount of time without an input signal from the throttle lever position sensor.

Further aspects, features and advantages of the inventions disclosed herein will become apparent from the detailed description of the preferred embodiments which follow.

BRIEF DESCRIPTION OF THE DRAWINGS

The foregoing features, aspect, and advantages of the present inventions are described below with reference to the drawings of preferred embodiments that are intended to illustrate and not to limit the invention.

DETAILED DESCRIPTION OF THE PREFERRED EMBODIMENT

Figure 1:
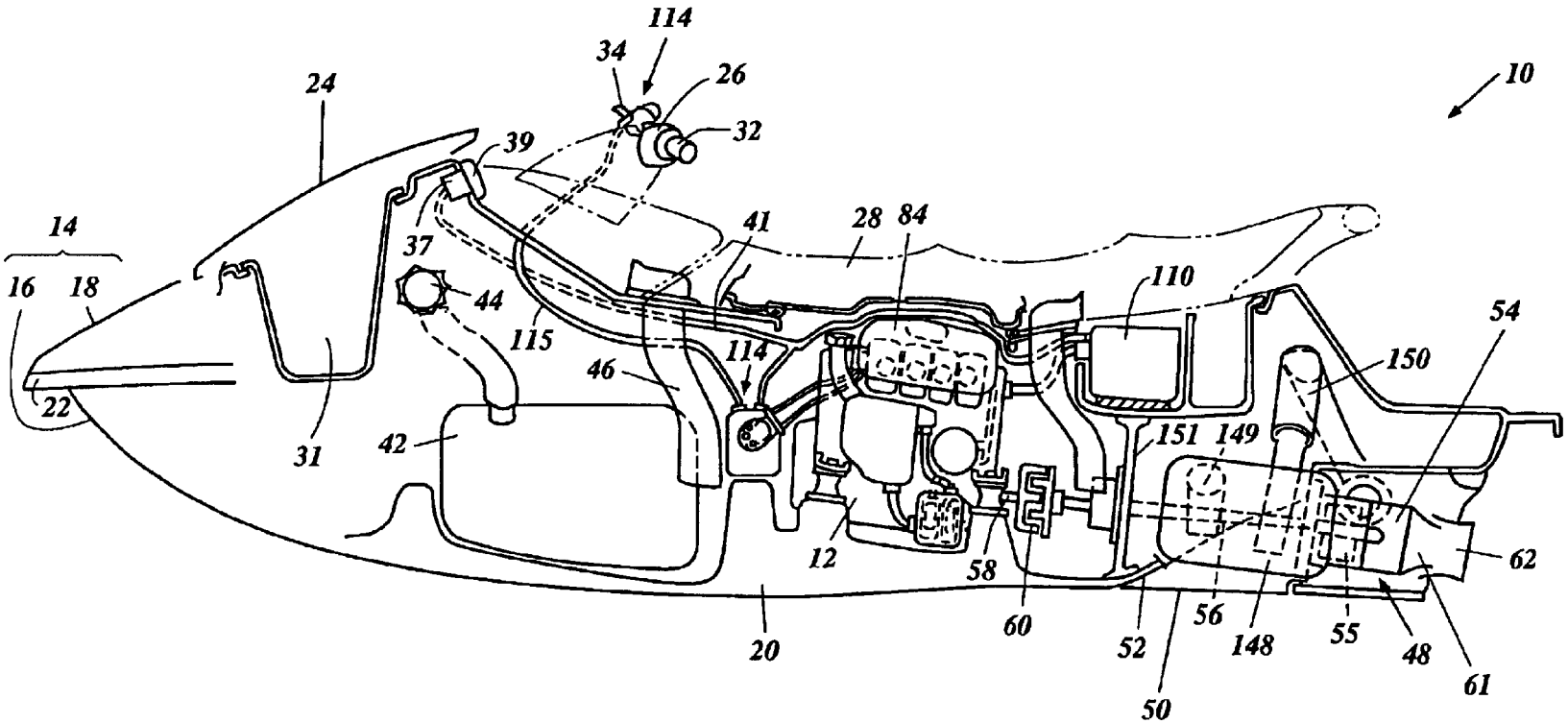
FIG. 1 is a side elevational-sectioned view of a personal watercraft of the type powered by an engine and includes an electronic throttle control system in accordance with an embodiment.
Figure 2:
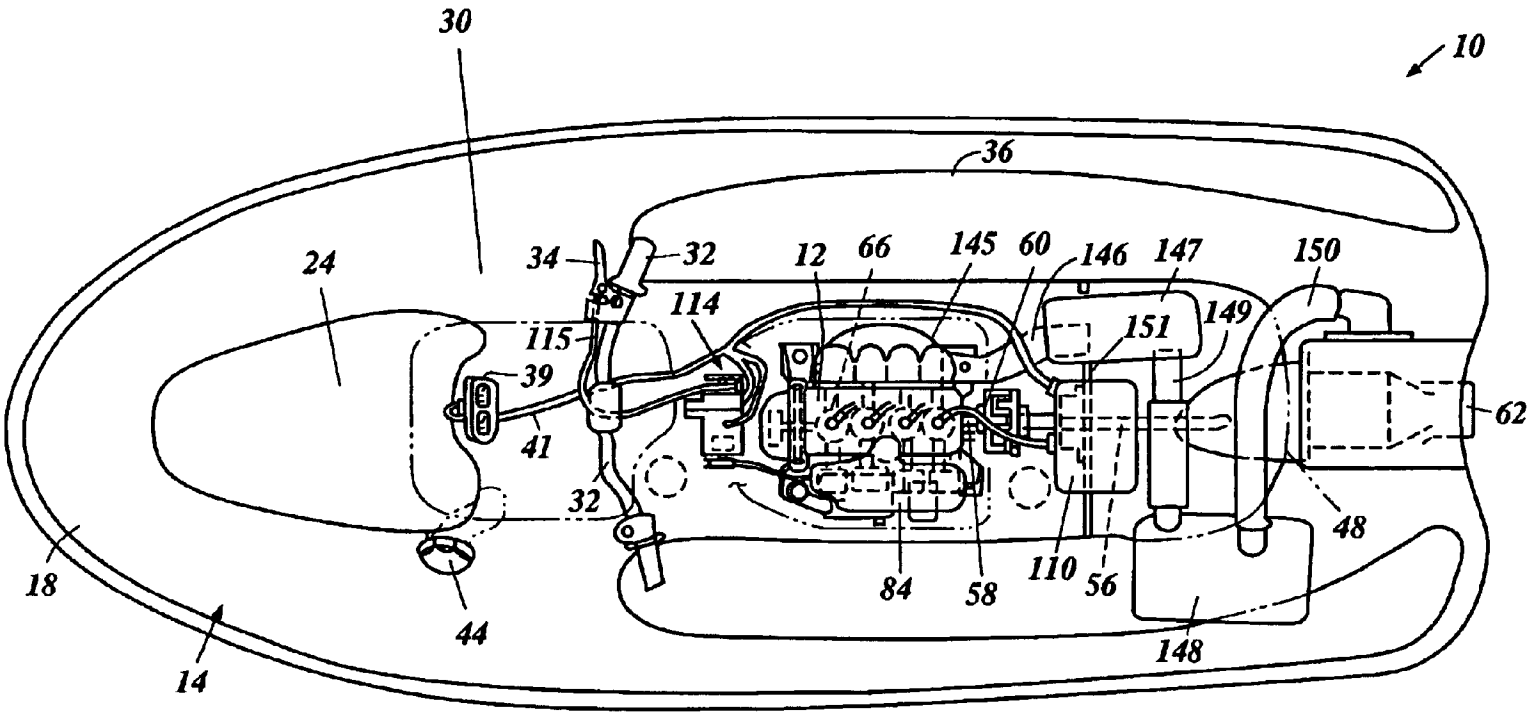
FIG. 2 is a top plan view of the watercraft of FIG. 1 illustrating the engine and several other internal components including the steering controls and an exhaust system.

With reference to FIGS. 1 and 2, an overall configuration of a personal watercraft 10 is described below. The watercraft 10 employs an electronic throttle system, which is configured in accordance with preferred embodiments. The described electronic throttle system configuration has particular utility for use with personal watercraft, and thus, is described in the context of personal watercraft. The electronic throttle system however, also can be applied to other types of vehicles and equipment using internal combustion engines, such as, for example, automobiles, motorcycles, generators, small jet boats and other vehicles.

With reference initially to FIG. 1, the personal watercraft 10 includes a hull 14 formed with a lower hull section 16 and an upper hull section or deck 18. The lower hull section 16 and the upper hull section 18 preferably are coupled together to define an internal cavity 20. A bond flange 22 defines an intersection of both of the hull sections 16, 18.

The illustrated upper hull section 18 preferably comprises a hatch cover 24, a control mast 26, and a seat 28, which are arranged generally in seriatim from fore to aft. In the illustrated arrangement, a forward portion of the upper hull section 18 defines a bow portion 30 (FIG. 2) that slopes upwardly. An opening can be provided through the bow portion 30 so the rider can access an internal storage compartment 31. The hatch cover 24 can be detachably affixed (e.g., hinged) to the bow portion 30 to resealably cover the opening.

The control mast 26 extends upwardly to support a handle bar 32. The handle bar 32 is provided primarily for controlling the direction of the watercraft 10. The handle bar 32 preferably carries other mechanisms, such as, for example, a throttle lever 34 that is used to control the engine output (i.e., to vary the engine speed), a main switch 35, and a starter switch 47 that is used to initiate a starter motor (not shown). A speedometer 37 as well as other gauges can be supported by a bracket 39 (FIGS. 1 and 2). The speedometer 37 as well as other gauges can electrically communicate with electrical systems of the watercraft 10 through a wiring harness 41.

The seat 28 extends rearwardly from a portion just rearward of the bow portion 30. In the illustrated arrangement, the seat 28 has a saddle shape. Hence, a rider can sit on the seat 28 in a straddle fashion. Foot areas 36 are defined on both sides of the seat 28 along a portion of the top surface of the upper hull section 18. The foot areas 36 are formed generally flat but may be inclined toward a suitable drain configuration.

A fuel tank 42 is positioned in the cavity 20 under the bow portion 30 of the upper hull section 18 in the illustrated. A fuel filler duct preferably couples the fuel tank 42 with a fuel inlet port positioned at a top surface the bow 30 of the upper hull section 18. A closure cap 44 (FIG. 2) closes the fuel inlet port to inhibit water infiltration.

An engine 12 is disposed in an engine compartment defined, for instance within the cavity 20. The engine compartment preferably is located under the seat 28, but other locations are also possible (e.g., beneath the control mast or in the bow). In general, the engine compartment is defined within the cavity 20 by a forward and rearward bulkhead. Other configurations, however, are possible.

A pair of air ducts 46 are provided in the illustrated arrangement such that the air within the internal cavity 20 can be readily replenished or exchanged. The engine compartment, however, is substantially sealed to protect the engine 12 and other internal components from water.

A jet pump unit 48 propels the illustrated watercraft 10. Other types of marine drives can be used depending on the application. The jet pump unit 48 preferably is disposed within a tunnel 50 formed on the underside of the lower hull section 16. The tunnel 50 has a downward facing inlet port 52 opening toward the body of water. A jet pump housing 54 is disposed within a portion of the tunnel 50. Preferably, an impeller 55 is supported within the jet pump housing 54.

An impeller shaft 56 extends forwardly from the impeller and is coupled with a crankshaft 58 of the engine 12 by a suitable coupling device 60. The crankshaft 58 of the engine 12 thus drives the impeller shaft 56. The rear end of the housing 54 defines a discharge nozzle 61. A steering nozzle 62 is affixed proximate the discharge nozzle 61. The steering nozzle 62 can be pivotally moved about generally vertical axis. The steering nozzle 62 is connected to the handle bar 32 by a cable or other suitable arrangement so that the rider can pivot the nozzle 62 for steering the watercraft.

Figure 3:
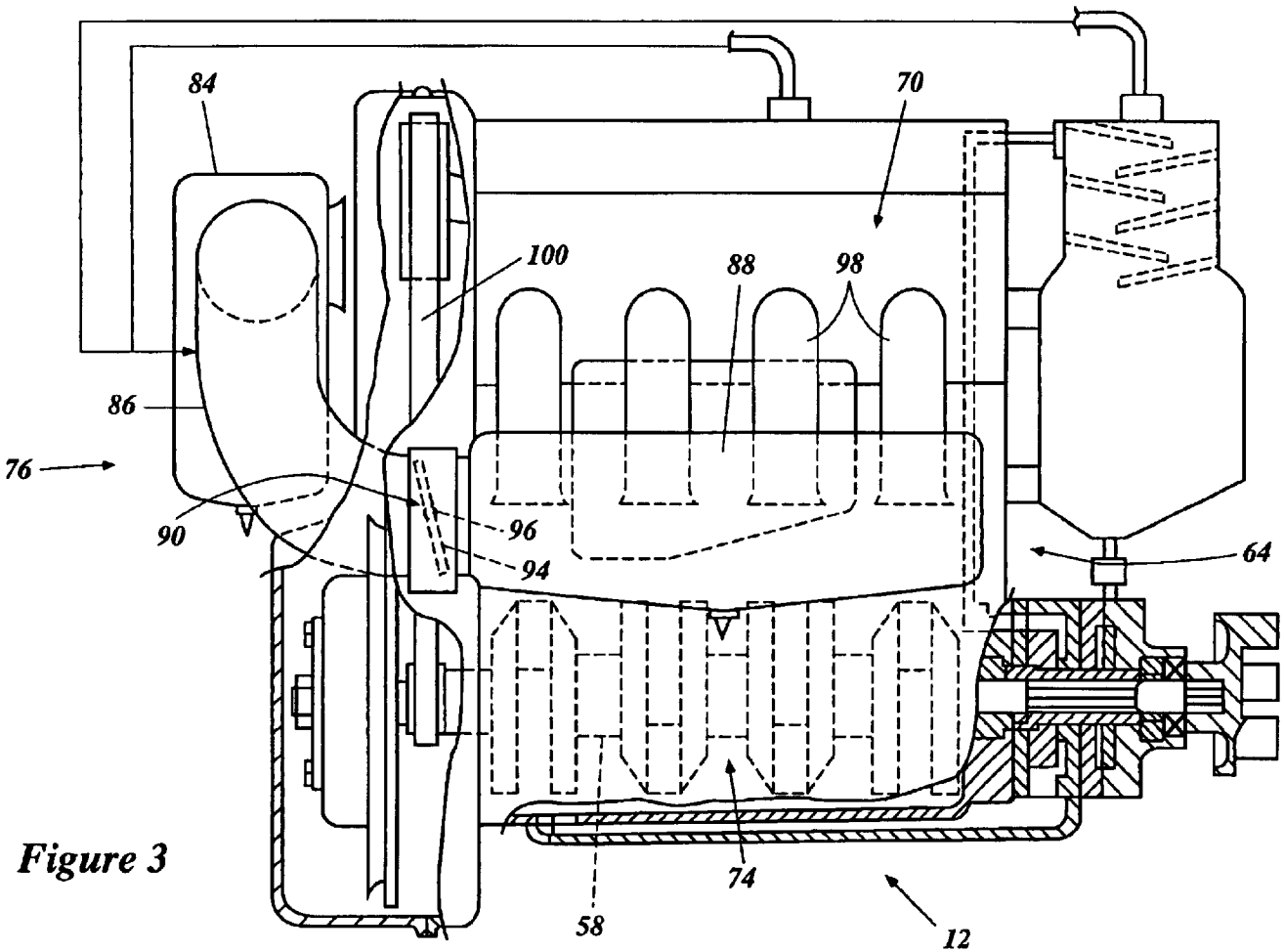
FIG. 3 is a side elevational and partially sectioned view of the engine illustrating an intake system, an engine body and a crankshaft.

With reference to FIG. 3, the engine 12 in the illustrated arrangement operates on a four-stoke cycle combustion principal. The engine 12 is an inclined L4 (in-line four cylinder) type. The illustrated engine, however, merely exemplifies one type of engine on which various aspects and features of the present invention can be used. Engines having a different number of cylinders, other cylinder arrangements, other cylinder orientations (e.g., upright cylinder banks, V-type, opposed, and W-type), and operating on other combustion principles (e.g., crankcase compression two-stroke, diesel, and rotary) are all practicable. Many orientations of the engine are also possible (e.g, with a transversely or vertically oriented crankshaft).

With continued reference to FIGS. 2 and 3, a piston (not shown) reciprocates in each of four cylinder bores 66 formed within a cylinder block 64. A cylinder head member 70 is affixed to the upper end of the cylinder block 64 to close respective upper ends of the cylinder bores 66. The cylinder head member 70, the cylinder bores 66 and the pistons together define combustion chambers (not shown).

A lower cylinder block member or crankcase member 74 is affixed to the lower end of the cylinder block 64 to close the respective lower ends of the cylinder bores 66 and to define, in part, a crankshaft chamber. The crankshaft 58 is journaled between the cylinder block 64 and the lower cylinder block member 74. The crankshaft 58 is rotatably connected to the pistons through connecting rods (not shown).

The cylinder block 64, the cylinder head member 70 and the crankcase member 74 together generally define an engine block of the engine 12. The engine 12 preferably is made of an aluminum-based alloy.

The engine 12 preferably includes an air induction system 76 to guide air to the engine 12. The air induction system includes an air intake silencer 84 for smoothing intake airflow. The air intake silencer 84 in the imputed embodiment is generally rectangular, however other shapes of the air intake silencer 84 of course are possible. An air intake duct 86 provides fluid communication between the air intake silencer 84 and a plenum chamber 88. The plenum chamber 88 can vary in size, however the plenum chamber 88 preferably is as large as possible while still allowing for positioning within the space provided in the engine compartment.

A throttle body 90 is advantageously positioned between the air intake duct 86 and the plenum chamber 88. The throttle body 90 includes a throttle plate 94 mounted to a throttle plate shaft 96, although other types of valves can be used. The throttle plate 94 rotates along a throttle plate shaft axis and regulates the amount of intake air entering the combustion chambers.

Air intake passages 98 connect the plenum chamber 88 to the cylinder head member 70 allowing the intake air to enter the combustion chambers through the individual air intake passages 98.

An intake camshaft (not shown) has cam lobes each associated with the respective intake valves (not shown), and an exhaust camshaft (not shown) also has cam lobes associated with respective exhaust valves (not shown). The intake and exhaust valves normally close intake and exhaust ports by a biasing force of springs. When the intake and exhaust camshafts rotate, the cam lobes push the respective valves to open the respective ports by overcoming the biasing force of the spring. Air enters the combustion chambers when the intake valves open. In the same manner, the exhaust gases exit from the combustion chambers when the exhaust vales open.

The crankshaft 58 preferably drives the intake camshaft and the exhaust camshaft. The respective camshafts have driven sprockets affixed to ends thereof while the crankshaft 58 has a drive sprocket. Each driven sprocket has a diameter that is twice as large as a diameter of the drive sprocket. A timing chain or belt 100 is wound around the drive and driven sprockets. When the crankshaft 58 rotates, the drive sprocket drives the driven sprocket via the timing belt 100, and thus the intake and exhaust camshaft also rotate.

Figure 4:
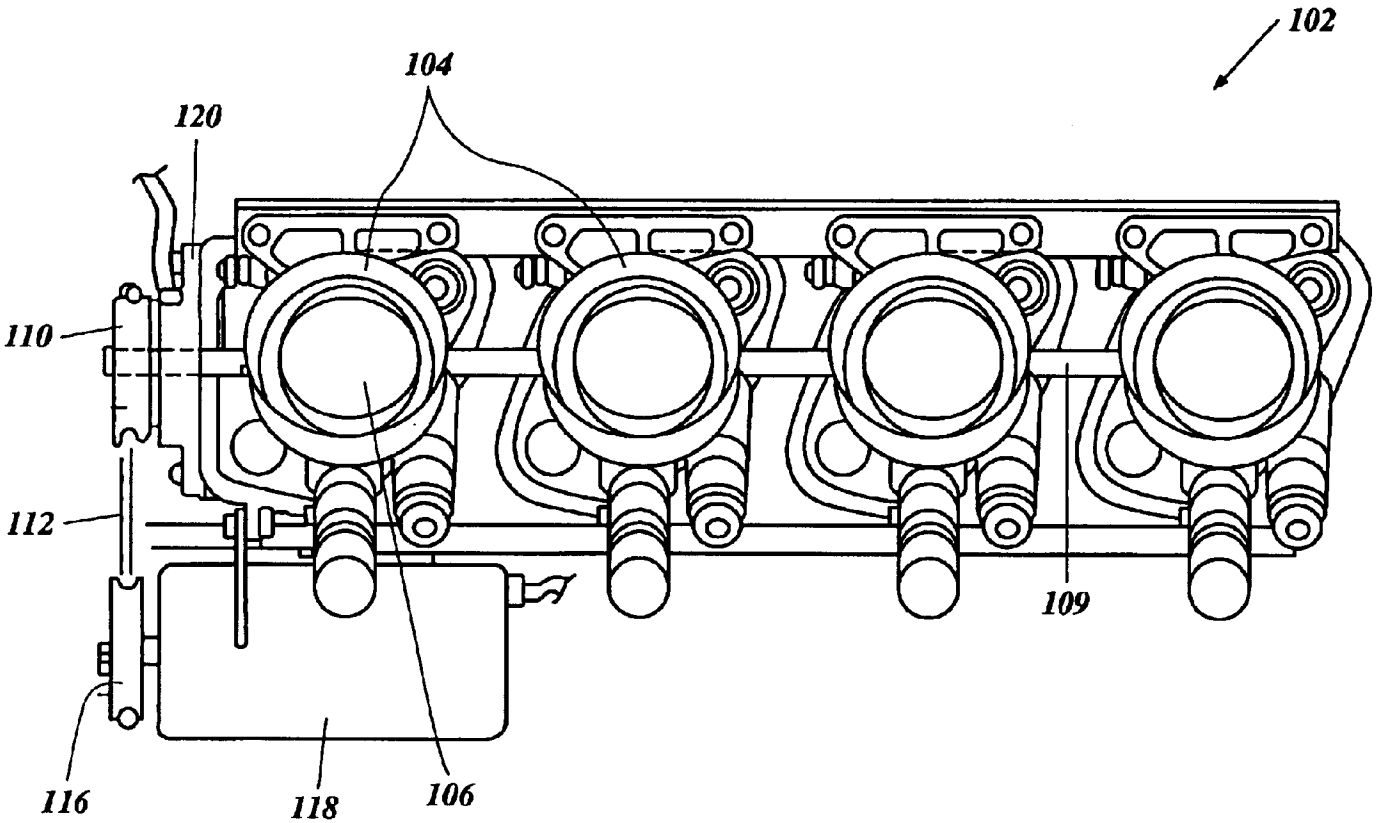
FIG. 4 is a side elevational view of an electronic throttle body assembly illustrating a motor that activates individual throttle bodies.

With reference to FIG. 4, another preferred embodiment of the air intake system 76 is shown. A throttle housing 102 includes individual throttle bodies 104 that correspond to each air intake passage 98. Each individual throttle body 104 includes an individual throttle plate 106. Each throttle plate 106 is mounted on a common shaft 109 that allows all the throttle plates 106 to rotate in unison.

A throttle shaft pulley 110 is connected to the common throttle shaft 109 and can be rotted by a flexible transmitter 112 by a drive pulley 116 connected to a motor 118. The motor 118 can turn the throttle shaft 109 using the flexible transmitter 112. The motor 118 can also be used to turn the throttle shaft 96 of the throttle body 90. The motor 118 can also be directly connected to the throttle shafts 96, 108. The motor 118 turns the throttle shafts 96, 109 according to a signal received from an electronic control unit (ECU, FIG. 5) 98.

A throttle position sensor (TPS) 120 detects the rotational position of the throttle shafts 96, 109 and communicates the throttle position to the ECU 98. The electronic throttle control which can include an initialization and a periodic activation of the throttle valve using the motor 118 to prevent faulty operation due to corrosion is described below in greater detail.

Figure 5:
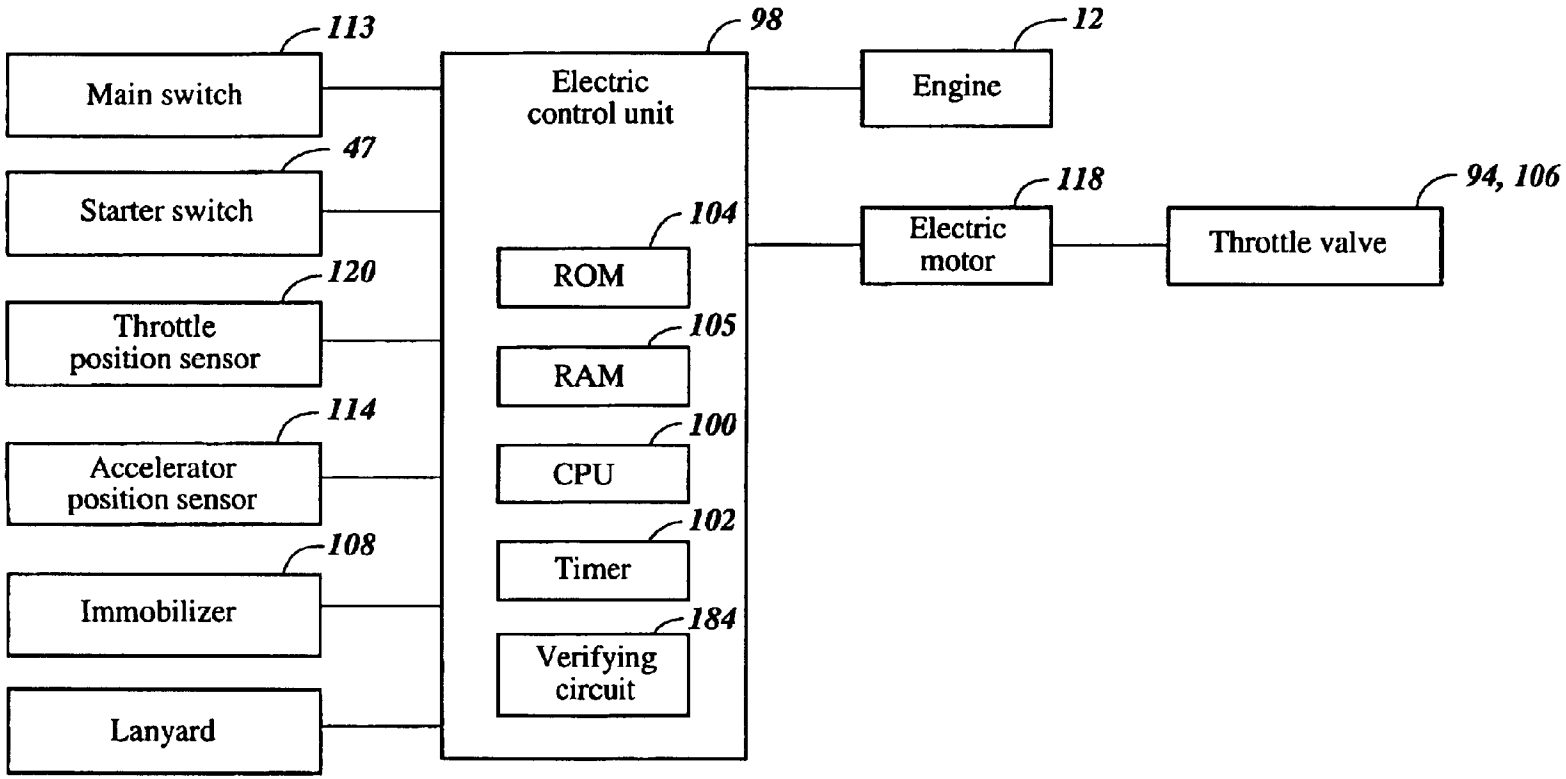
FIG. 5 is a block digram illustrating various electronic components of the personal watercraft including an immobilize, an electronic control unit, an engine, and an throttle valve operated by an electric motor.

With reference to FIG. 5 in some embodiments, the ECU 98 is a microcomputer that includes a micro-controller having a central processing unit (CPU) 100, a timer 102, and memory allocations. The memory allocations comprise at least one read only (ROM) 104 and at least one random access memory (RAM) 105. Of course, other suitable configurations of the ECU 98 also can be used. Preferably, the ECU 98 is configured with or capable of accessing various maps to control engine operation in a suitable manner.

The ECU 98 communicates with various of the watercraft 10 including, but not limited to, a main switch 113 that can be used to initiate the electrical components of the watercraft 10. An accelerator or throttle lever position sensor 114 measures the position of the throttle lever 34 and communicates the corresponding signal to the ECU 98. The position of the throttle lever 34 is indicative of a torque request from the operator. The ECU 98 receives the operators torque request and can signal to the motor 118 the target position of the throttle plates 94, 106. The throttle position sensor 120 senses the throttle plate position and provides a feedback signal to the ECU 98. The feedback signal allows the ECU 98 to determine if the throttle plates 94, 106 are in the correct position that corresponds to the operators torque request. The ECU 98 can also use the operator torque request to calculate the proper amount of fuel to be injected into the engine and to calculate the correct ignition timing.

The accelerator position sensor 114 can be positioned directly next to the throttle lever 34 or the accelerator position sensor 114 can be remotely positioned from the throttle lever 34. A remotely positioned accelerator sensor 114 can be activated by the throttle lever 34 through a cable 115 that is attached to the throttle lever 34.

The ECU 98 can also communicate with an immobilizing unit 108. The immobilizing unit 108 can communicate with a receiver 174 and a transmitter 190. The operation of the immobilizing unit and the communication between the immobilizing unit 108, the receiver 174, and the transmitter 190 is described in greater detail below.

The ECU 98 is advantageously housed in an electrical component box 110 and communicates through a cable 112 with various electrical devices including, but not limited to, the immobilizing unit 108 and electrical subsystems of the engine 12. The electrical component box 110 is preferably located behind the engine 12 underneath the seat 28. Although other locations for the electrical box 110 are possible, the location behind the engine 12 and underneath the seat 28 provides an area well protected from water intrusion.

The engine 12 also includes a fuel injection system which preferably includes one fuel injector (not shown) for each cylinder, each having an injection nozzle exposed to intake ports (not shown) so that injected fuel is directed toward combustion chambers (not shown). Thus, in the illustrated arrangement, the engine 12 feature port fuel injection. Other types of indirect or direct fuel injection system can also be used.

Fuel is drawn from the fuel tank 42 and delivered to the fuel injectors. Excess file that is not injected by the fuel injector returns to the fuel tank 42. In operation, a predetermined amount of fuel is sprayed into the engine 12 via the injection nozzles of the fuel injectors. The timing and duration of the fuel injection is dictated by the ECU 98 based upon any desired control strategy.

The engine 12 further includes an ignition system. Four spark plugs (not shown) are fixed on the cylinder head member 70. The spark plugs ignite an air/fuel charge just prior to, or during, each power stroke, preferably under the control of the ECU 98 to ignite the air/fuel charge therein.

The engine 12 further includes an exhaust system 145 to discharge burnt charges, i.e., exhaust gases, from the engine 12. An exhaust pipe 146 extends rearwardly along a port side surface of the engine 12. The exhaust gases travel through the pipe 146 and into an exhaust chamber 147 that is positioned within a rear bulkhead 151. The exhaust gases travel further from the exhaust chamber 147 though an exhaust conduit 149 to a water-lock 148 proximate a forward surface of the water-lock 148. A discharge pipe 150 extend from a top surface of the water-lock 148. The discharge pipe 150 bends transversely across the center plane and rearwardly toward a stern of the watercraft.

Preferably, the discharge pipe 150 opens at a stern of the lower hull section 16 in a submerged position, at least during idle and/or low speed operation. As is known, the water-lock 148 generally inhibits water in the discharge pipe 150 or the water-lock itself from entering the exhaust pipe 146.

The engine 12 further includes a cooling system configured to circulate coolant into thermal communication with at least one component within the watercraft 10. Preferably, the cooling system is an open-loop type of cooling system that circulates water drawn from the body of water in which the watercraft 10 is operating through thermal communication with heat generating components of the watercraft 10 and the engine 12. Other types of cooling systems can also be used. For instance, in some applications, a closed-loop type liquid cooling system can be used to cool the engine 12.

The present cooling system preferably includes a water pump arranged to introduce water from the body of water surrounding the watercraft 10. The jet propulsion unit preferably is used as the water pump with a portion of the water pressurized by the impeller being drawn off for use in the cooling system, as is generally known in the art.

The engine 12 preferably includes a lubrication system that delivers lubricant oil to engine portions for inhibiting frictional wear of such portions. In the illustrated embodiment, a dry-sump lubrication system is employed. This system is a closed-loop type and includes an oil reservoir.

In order to determine appropriate engine operation control scenarios, the ECU 98 preferably uses control maps and/or indices stored within the ECU 98 in combination with data collected from various input sensor. All of the ECU's 98 various input sensors are not shown, however they can include, but are not limited to, a manifold pressure sensor, an engine coolant temperature sensor, an oxygen ($O_2$) sensor, and a crankshaft speed sensor.

It should be noted that the above-identified sensors are merely some of the sensors that can be used for engine control and it is, of course, practicable to provide other sensors, such as an intake air pressure sensor, an intake air temperature sensor, a knock sensor, a neutral sensor, a watercraft pitch sensor, a shift position sensor and an atmospheric temperature sensor. The selected sensors can be provided for sensing engine running conditions, ambient conditions or other conditions of the engine 12 or associated watercraft 10.

During engine operation, ambient air enters the internal cavity 20 defined in the hull 14. The air is then introduced into the engine 12. At the same time, the fuel injectors spray fuel into the engine 12 under the control of ECU 98. Air/fuel charges are thus formed and delivered to the combustion chambers. The air/fuel charges are fired by the spark plugs under the control of the ECU 98. The burnt charges, i.e., exhaust gases, are discharged to the body of water surrounding the watercraft 10 through the exhaust system.

Often times, watercraft are used in salt water conditions or are stored and left unused for extended periods of time. Due to long periods of non-operation, corrosion prone environments, and/or age of the components the throttle plates 94, 106 can become hard to move from corrosion or debris building up around the throttle shafts 96, 109. To extend proper operation of the engine 12, the electronic throttle control system can be configured to activate the electric motor 118 at predetermined time periods. Activating the throttle motor 118 at predetermined time periods turns the throttle shafts 96, 109, thereby preventing or debris from inhibiting throttle movement. The predetermined periods can include for example, before the engine is started or after the engine has been stopped, although other predetermined time periods are also possible.

In another preferred embodiment of the electronic throttle control system, the throttle is activated by the electric motor 118 whenever the main switch 113 is activated. For example, when an operator turns on the main switch 113, the ECU 98 can send a signal to the throttle motor 118, which in en will open and close the throttle.

A further advantage is provided where the movement of the throttle valve(s) 94, 106 and/or the shaft 96, 109 is detected and used to determine if the throttle system is working properly.

For example, but without limitation, the throttle position sensor 120 can be configured to detect the movement of the throttle valve(s) 94, 109 and/or shaft 96, 109 and sends a feedback signal to the ECU 98. The ECU 98 can be configured to compare the throttle motor signal and the feedback signal and determine if the throttle valve(s) 94, 109 and/or shaft 96, 109 are moving properly.

In some embodiments, the throttle can be determined to be operating properly if the throttle motor signal sent from the ECU 98 to the throttle motor 118 conforms to a predetermined relationship to the feedback signal sent from the throttle position sensor 120 to the ECU 98. The throttle position sensor signal can also be compared to the signal from the accelerator position sensor 114 to ensure proper communication between the accelerator position and the throttle position. The various signal verifications performed by the ECU 98 as explained above ensure proper operation of the electronic throttle control system. For example, if the throttle valves 94, 106 and/or shafts 96, 109 are operating pay, the throttle valves 94, 106 and/or shafts 96, 109 move without obstruction, and against the bias of any springs that may be used, such as return springs. Thus, the signal from the throttle position sensor will correlate to the signal sent to the throttle motor 118. However, if the throttle valves 94, 106 and/or shafts 96, 109 are not operating properly, due to corrosion or obstructions caused by debris, the throttle valves 94, 106 and/or shafts 96, 109 will move more slowly than normal. Thus, the signal from the throttle position sensor will not correlate in the same manner to the signal sent to the throttle motor 118 move too slowly. For example, the throttle valves 94, 106 and/or shafts 96, 109 may move more slowly than normal. Thus, the various signal verifications inhibit faulty operation due to the watercraft being operated in salt water conditions or stored and left unused for extended periods of time.

In some embodiments, the throttle is activated by the electric motor 118 whenever a security system receiver 174 receives a signal from a transmitter 190. The security system receiver 174 is mounted in a predetermined location. The location of the security system receiver 174 is meant to be out of view to inhibit impermissible access to the security system receiver 174.

When the transmitter 190 is within a predetermined distance range of the receiver 174, the receiver is able to receive signal from the transmitter 190. The signals sent by the transmitter 190 and received by the receiver 174 are further communicated with the immobilization unit 108. The immobilization unit 108 accordingly permits or prevents the engine 12 from being started. The immobilization unit 108 can also stop the engine 12 from operating if the engine 12 has already started and has been running. The immobilization unit 108 can also send a signal to the ECU 98 to initiate the throttle motor 118 to open and close the throttle to ensure proper operation of the throttle.

Figure 6:
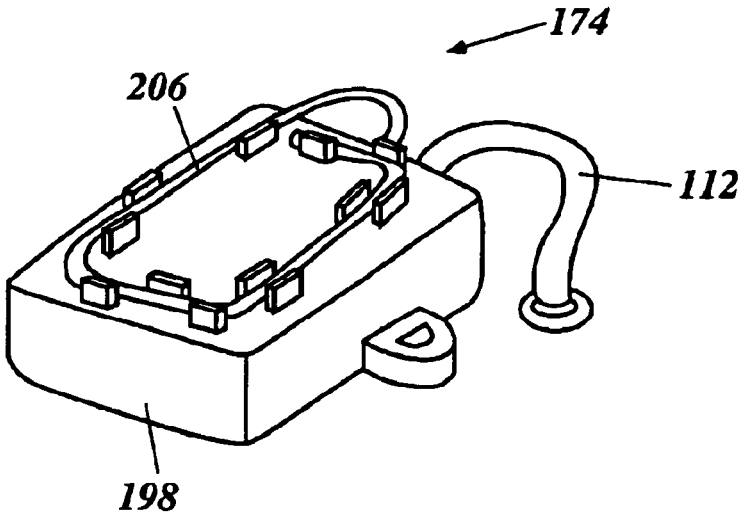
FIG. 6 is a perspective view of a receiver including a receiver housing and a predetermined secured position of a corresponding receiver antenna.

FIG. 6 illustrates a receiver housing 198 that mounts to various predetermined locations on the watercraft 10. An antenna 206 is advantageously routed on the receiver housing 198 to allow an extended length of the antenna to be neatly positioned on the receiver housing 198. The extended length of the antenna 206 allows for improved reception and therefore improved communication between the receiver 174 and the transmitter 190. The neat position of the antenna 206 on the receiver 174 prevents the antenna 206 from possibly tangling with other wires or becoming caught in an access lid.

Figure 7:
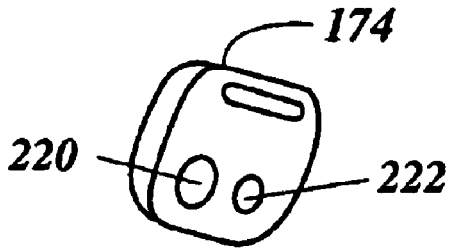
FIG. 7 is a perspective view of a transmitter including an engine lock button and an engine unlock button.

FIG. 7 illustrates a preferred embodiment of the transmitter 190 which can include a lock button 220 and an unlock button 222. When the receiver 174 and the transmitter 190 have established communication with each other, i.e., the identifying information input signal transmitted from the transmitter 190 has been identified by the receiver 174, the transmitter can send lock and unlock signals. For example, after the transmitter 190 and the receiver have estabilished communication with each other, the operator can push the lock button 220. Pushing the lock button 220 communicates to the receiver that the engine 12 cannot operate, i.e. the engine 12 cannot be stated or cannot continue to operate if the engine is already running.

After the transmitter 190 and the receiver have established communication with each other, the operator can also push the unlock button 222. Pushing the unlock button 222 communicate to the receiver that the engine 12 can operate, i.e. the engine 12 can be started or can continue to operate if the engine is already running. After the operator has pressed the lock button 220 or the unlock button 222 the immobilizing unit 108 can send a signal to the ECU 98 to initiate the throttle motor 118. The signal received from the immobilizing unit 108 can allow the ECU 98 to send a signal to the throttle motor 118 to open and close the throttle to ensure proper operation of the throttle. The periodic throttle operation verification signals inhibit faulty operation due to the watercraft being operated in salt water conditions or stored and left unused for extended periods of time.

A control routine illustrated in FIG. 8 can be used in conjunction with any of the embodiments described above for periodic ally activating the electronic throttle and the electronic throttle signal verification to ensure proper throttle operation is described below.

Figure 8:
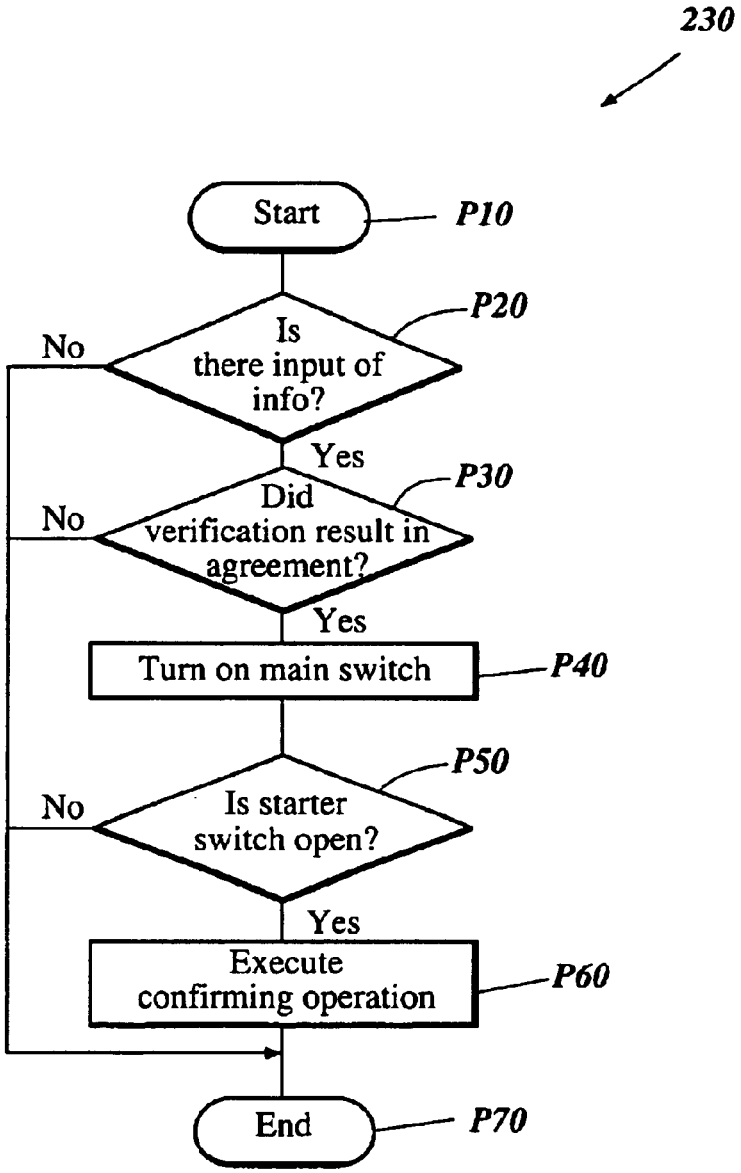
FIG. 8 is a block diagram showing a control routine which can be used in conjunction with the embodiments of FIGS. 1–7.

With reference to FIG. 8, a control routine 230 is shown that is arranged and configured in accordance some embodiments. The control routine 230 is configured to control operation of perodic activation and signal verification of the watercraft electronic throttle control. The control routine begs at an operation block P10. In the illustrated embodiment, the routine 230 can start as soon as a rider attempts to start the engine 12, for example, as soon as the start button is activated, or when the main switch 113 is closed. However, it is to be understood that the routine 230 can start at any time. After the operation block P10, the routine 230 moves to a decision block P20.

In the decision block P20, it is determined if any transmitter verifying information has been received by the receiver. Each transmitter can be programmed to communicate with a corresponding receiver. The transmitter can constantly or periodically send a verifying signal to achieve communication with the corresponding receiver. If it is determined that transmitter verifying information has not been received, the control routine 230 proceeds to an operation block P70 where the control routine 230 ends.

If, however, in the decision block P20, it is determined that a correct transmitter verifying information signal has been received, the control routine 230 moves to a decision block P30.

In the decision block P30, it is determined if the transmitted signal can be verified. Once the transmitted signal from the transmitter is received and verified by the receiver, the transmitter and corresponding receiver can communicate.

If in decision block P30 it is determined that the transmitted signal cannot be verified, the control routine 230 proceeds to the operation block P70 and ends. If, however, in decision block P30 the transmitted signal can be verified, the control routine 230 proceeds to an operation block P40.

In the operation block P40, the main switch is closed and power is sent to various watercraft systems allowing the watercraft system to operate. The watercraft systems can include, but are not limited to, the ignition system, the fuel system, etc. The control routine 230 then proceeds to a decision block P50.

In decision block P50, it is determined if the starter switch is closed. The starter switch operates a starter that rotates the engine at a predetermined speed to allow the engine to commence. If it is determined that the start switch has not been closed, the control routine 230 proceeds to the operation block P70 and ends.

If, however, it is determined in decision block P50 that the starter switch has been closed, the control routine 230 proceeds to an operation block P60 where the periodic activation of the watercraft electronic throttle valve is performed and the watercraft electronic throttle valve signal is verified. For example, the ECU 98 can send a signal to the throttle motor 118, which in turn will open and close the throttle valves 94, 106. The throttle position sensor can detect the movement of the throttle and can send a feedback signal to the ECU 98. The ECU 98 can then compare the throttle motor signal and the feedback signal and determinees if the throttle is working properly.

The throttle valves 94, 106 can be determined to be operating properly if the throttle motor signal sent from the ECU 98 to the throttle motor 118 matches the feedback signal sent from the throttle position sensor to the ECU 98. The throttle position sensor signal can also be compared to the signal from the accelerator position sensor to ensure proper communication between the accelerator position and the throttle position. The control routine then proceeds to operation block P70 where the control routine 230 ends.

Figure 9:
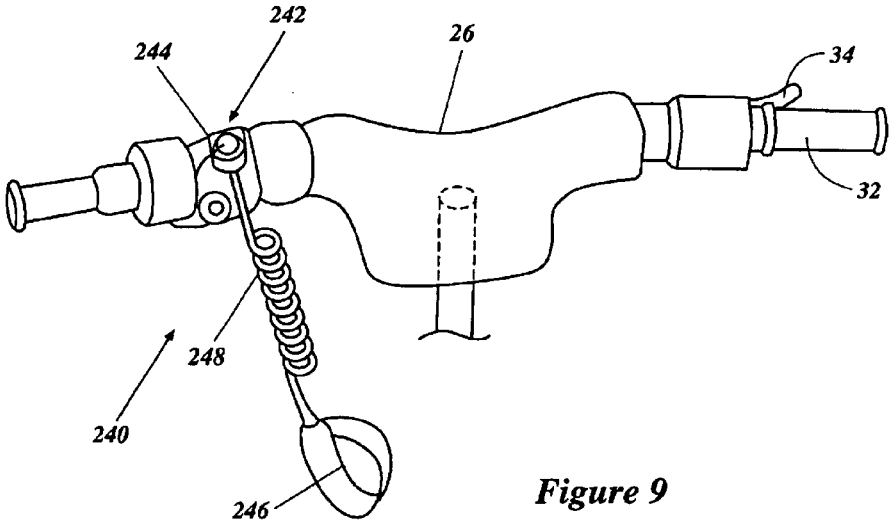
FIG. 9 is a perspective view of a steering assembly including a handlebar, a throttle lever, a control mast, and a lanyard system.

With reference to FIG. 9 a lanyard system 240 is illustrated that is mounted on the control mast 26. The lanyard system 240 includes a lanyard switch 242 The lanyard switch 242 can be an on-off switch and the lanyard switch can be used in combination with or replace the main switch 113. Therefore, the lanyard switch 242 when closed can allow an electrical signal to initiate power to various system on the watercraft. When the lanyard switch 242 is opened, the power-initiating signal is disrupted. A lanyard clip 244 is attached to an adjustable wrist band 246 through a flexible cord 248. As is well know to someone familiar in the art, the lanyard switch 242 can be opened and a signal disrupted when an operator and therefore the lanyard clip 244 travels beyond a predetermined distance from the watercraft 10.

When the lanyard switch is opened or closed the ECU 98 can activate the electronic throttle motor 118 and verily if the throttle valve has moved correctly with regard to the position of the throttle motor 118. The periodic movement of the electronic throttle and the varification of the electronic throttle movement allows the electronic throttle control system to provide a correctly operating electronic throttle regardless of the operating environment of the watercraft 10.

Although the present inventions have been described in terms of a certain preferred embodiments, other embodiments apparent to those of ordinary skill in the art also are within the scope of the inventions. Thus, various changes and modifications may be made without departing from the spirit and scope of the inventions. For instance, various steps within the routines may be combined, separated, or reordered. Moreover, not all of the features, aspects and advantages are necessarily required to practice the present inventions. Accordingly, the scope of the present inventions is invaded to be defined only by the claims that follow.

What is claimed is:

1. An engine comprising a controller communicating with at least a throttle lever position sensor, a throttle motor, and a throttle position sensor, the controller configured to control the throttle motor to move a throttle to a predetermined position according to a signal from a throttle lever that is connected to the throttle lever position sensor, to compare a signal from the throttle position sensor to the signal from the throttle lever position sensor and to adjust the throttle position to a corrected throttle position according to the sensed throttle lever position, the controller further configured to periodically activate the throttle motor to open the throttle to a predetermined position for a predetermined amount of time without an input signal from the throttle lever position sensor.

2. The watercraft of claim 1, wherein the controller is configured to activate the throttle motor for a predetermined amount of time whenever a main switch of the engine is activated.

3. The engine of claim 1, wherein the controller is configured to activate the throttle motor for a predetermined amount of time whenever a starter of the engine is activated.

4. The engine of claim 1, wherein the controller is configured to activate the throttle motor for a predetermined amount of time after the engine has been shut off for a predetermined amount of time.

5. The engine of claim 1, wherein the controller is configured to activate the throttle motor for a predetermined amount of time whenever a kill switch is activated.

6. The engine of claim 1, wherein the controller is configured to communicate with a security system comprising a receiver and a transmitter, the controller also being configured to activate the throttle motor for a predetermined amount of time whenever the transmitter and the receiver have established communication and the receiver sends a signal to the controller.

7. The engine of claim 1, in combination with a watercraft in which the engine provide a propulsive power for providing thrust for the watercraft.

8. A method of controlling a of a parameter of a multi-cylinder engine, the method comprising sensing a position of a throttle lever, controlling a motor that activates a throttle according to the position of the throttle lever, sensing a throttle position and comparing the sensed throttle position with the sensed throttle lever position and adjusting the throttle position to a corrected throttle position according to the sensed throttle lever position, and periodically activating the motor at a predetermined time for a predetermined amount of time according to a predetermined condition.

9. The method of claim 7, wherein the predetermined condition is when a main switch is activated.

10. The method of claim 7, wherein the predetermined condition is when a starter switch is activated.

11. The method of claim 7, wherein the predetermined condition is when a predetermined amount of time has passed after the engine has been stopped.

12. The method of claim 7, wherein the predetermined condition is when a kill switch is activated.

13. The method of claim 7 further comprising a security system comprising a receiver and a transmitter, the method comprising the controller activating the throttle motor for a predetermined amount of time whenever the transmitter and the receiver have established communication and the receiver sends a signal to the controller.

14. An engine comprising a controller communicating with at least a throttle lever position sensor, a throttle motor, and a throttle position sensor, the controller configured to control the throttle motor to move a throttle to a predetermined position according to a signal from a throttle lever that is connected to the throttle lever position sensor, to compare a signal from the throttle position sensor to the signal from the throttle lever position sensor and to adjust the throttle position to a corrected throttle position according to the sensed throttle lever position, and means for periodically activating the throttle motor to open the throttle to a predetermined position for a predetermined amount of time without an input signal from the throttle lever position sensor.

* * * * *

UNITED STATES PATENT AND TRADEMARK OFFICE

CERTIFICATE OF CORRECTION

PATENT NO. : 6,889,654 B2
APPLICATION NO. : 10/852649
DATED : May 10, 2005
INVENTOR(S) : Kazumasa Ito It is certified that error appears in the above-identified patent and that said Letters Patent is hereby corrected as shown below:

At Column 12, Line 16, in Claim 8, after "controlling", please delete "a of".

Signed and Sealed this

Twenty-sixth Day of December, 2006

JON W. DUDAS
*Director of the United States Patent and Trademark Office*